US008278576B2

(12) United States Patent
Wechtenhiser

(10) Patent No.: US 8,278,576 B2
(45) Date of Patent: Oct. 2, 2012

(54) INTERCHANGEABLE AIR CONNECTOR ASSEMBLY FOR A PNEUMATICALLY ACTUATED SWITCHING DEVICE

(75) Inventor: Bert W. Wechtenhiser, Jacksonville, FL (US)

(73) Assignee: Dwyer Precision Products, Inc., Jacksonville, FL (US)

( * ) Notice: Subject to any disclaimer, the term of this patent is extended or adjusted under 35 U.S.C. 154(b) by 306 days.

(21) Appl. No.: 12/802,408

(22) Filed: Jun. 7, 2010

(65) Prior Publication Data

US 2011/0297526 A1 Dec. 8, 2011

(51) Int. Cl.
*H01H 3/24* (2006.01)

(52) U.S. Cl. ..... 200/82 R

(58) Field of Classification Search ..... 200/82 R, 200/81 H

See application file for complete search history.

(56) References Cited

U.S. PATENT DOCUMENTS

| | | | |
|---|---|---|---|
| 3,823,285 | A | 7/1974 | Dwyer |
| 5,155,309 | A | 10/1992 | Dwyer |
| 5,461,207 | A | 10/1995 | Van Lear |
| 5,736,702 | A | 4/1998 | Roberts |
| 5,999,100 | A | 12/1999 | Wright |

*Primary Examiner* — Vanessa Girardi

(74) *Attorney, Agent, or Firm* — Paul Bogdon

(57) ABSTRACT

A pneumatically actuated switching device includes an electrical connection with a conductive element and an interchangeable air connector assembly having an air conduit for receiving pressurized air from a pneumatic actuator. The pressurized air is directed into the housing of the switching device and forces a conductive plunger against the electrical connection for completing a circuit to produce a signal in a patient call system. The connector assembly has a snap fit connection constructed to selectively position the air conduit at a predetermined angle relative to the electrical connection, i.e. a first snap fit connector position the air conduit at a right angle with the electrical connection, and a second snap fit connector position the air conduit in alignment with the electrical connection. A method includes selectively inserting the first snap fit connector and the second snap fit connector into the housing depending on a desired system configuration.

13 Claims, 5 Drawing Sheets

INTERCHANGEABLE AIR CONNECTOR ASSEMBLY FOR A PNEUMATICALLY ACTUATED SWITCHING DEVICE

BACKGROUND OF THE INVENTION

1. Field of the Invention

The present invention relates to a pneumatically actuated switching device in a pneumatic actuator system for a patient call system. More specifically, the present invention relates to an interchangeable snap fit air connector assembly for a pneumatically actuated switching device connected to a pneumatic actuator of a patient call system.

2. Description of the Prior Art

Hospitals, and other patient-care institutions, frequently provide patient call systems wherein a patient may activate a signal to a central station, such as a nurse's station, to summon assistance. The use of conventional electrical switches to generate the signal in such environments is undesirable given the potentially combustible levels of oxygen that will likely be present near the patient.

As an alternative to conventional electrical switches, the use of a pneumatically actuated switch, which utilizes a pulse of pressurized air to actuate a signal circuit, avoided the safety concerns associated with a conventional switch. Such switches are particularly beneficial where combustion concerns may be present, as in oxygen rich environments, because the construction of the pneumatically actuated switch limits the possibility of arcing which is a problem associated with electrical switching.

U.S. Pat. No. 3,823,285 to Dwyer illustrates an example of a pneumatic actuated bulb device for a patient actuated nurse call system. A deformable pneumatic bulb provides a source of pressurized air to operate an electrical switching circuit that is well suited for use in environments where it is undesirable to use a conventional electrical switch as discussed in the preceding paragraph. A pneumatically actuated switching device comprises an electrically conductive sleeve having a bore. An electrically conductive ball is mounted in the bore and is movable in response to the pneumatic pressure. The other end of the bore is in communication with a tube to which is connected a source of pneumatic pressure, such as the deformable pneumatic bulb. Two conductors are adapted to be connected to two sides of an electrical circuit. The first conductor is in electrical communication with the sleeve and the second conductor is mounted in an opening in the sleeve which extends into the bore. The ball is movable between a circuit open position out of electrical communication with the second conductor, and a circuit closed position in electrical communication with the second conductor and the sleeve. A cam surface extends into the bore and into the path of the ball and cams the ball into electrical communication with the second conductor and the sleeve in the circuit closed position. The sleeve normally is oriented generally vertically, although the device operates satisfactorily when the sleeve is oriented almost horizontally because the ball moves in the bore with very little, if any, friction.

A further development of a pressurizing device is disclosed in U.S. Pat. No. 5,155,309 which embodies a pneumatic bulb having an annular ring configuration with a convexly shaped actuator dome resembling a doughnut to provide a distinctive identification to the bulb for distinction from other pneumatic bulbs that may be utilized for different purposes in a patient area. The construction of the pneumatic bulb includes a base plate to provide support for the bulb and support for a peripheral rim and a center post of the doughnut shaped actuator dome. The base plate includes protruding truncated conical members relied upon to maintain the doughnut shaped actuator at a fixed location on a patient's mattress so that the patient can reliably find the bulb to summon help.

These pneumatically actuated patient call systems comprise an air tube for delivering compressed air for activation of the electrical connection of a jack which is inserted into a receptacle of a wall switch unit of a patient call system. The receptacle can be either recessed into or flushed with a wall plate wherein an air tube positioned at a right angle relative to the electrical connection may be better suited for use with a receptacle that is flushed with the wall plate and wherein an air tube positioned in-line (straight jack) relative to the electrical connection may be better suited for use with a receptacle that is recessed into the wall plate of the wall switching unit.

U.S. Pat. No. 5,736,702 to Roberts, et al. discloses a pneumatically actuated switching device with a housing connection which provides for optional assembly orientations, i.e. an in-line assembly configuration for the switch housing and a right angle configuration for the switch housing relative to a jack for electrical connection with the receptacle of a patient call system. The optional assembly orientations are brought about via a connector which is partially enclosed within a cavity formed in an end of the housing. The cavity of the housing includes opposing side walls and a curved surface located between the side walls. The contour of the curved surface is compatible with the surface of the connector such that the two components can be brought into interfacing contact with one another. In order to maintain the interfacing contact between the connector and the housing, pins extend through the connector and through the opposing side walls of the housing thereby locking the two components together in a preselected angular orientation of the connector relative to the housing. The additional openings in the sidewalls provide for the different angular orientation options for the connector during the assembly of the switch. End connectors form the final closure for maintaining the locked assembly orientation by retaining the pins within the openings in the connector and the housing. The connector and the housing of this multi-position switching device is generally glued together once the pins are in the appropriate openings for forming a desired angular orientation of the connector relative to the housing.

There is a need for a pneumatically actuated switching device for delivering pressurized air for an electrical connection that easily provides an air connector assembly for connection to a housing supporting the electrical connection and which air connector assembly may be selected to provide a desired angle, i.e. an in-line air conduit assembly or a right angle air conduit assembly configuration for the switch housing relative to the electrical connection depending on the type of receptacle in the wall switch unit receiving the electrical connection.

SUMMARY OF THE INVENTION

The invention has met this need. An aspect of the present invention provides a pneumatically actuated switching device comprising: a housing having an air chamber; a conductive plunger and a contact spring in the air chamber of the housing; an electrical connection having a first portion extending from the housing and comprising a conductive element for insertion into a receptacle of a patient call system, and a second portion extending into the air chamber of the housing; and an interchangeable air connector assembly connectable to the housing and comprising an air conduit connectable to a pneumatic actuator for generating and discharging a quantity of pressurized air to said pneumatically actuated switching device for operation of the switching device.

The air conduit of the interchangeable air connector assembly is in communication with the air chamber of the housing for receiving the pressurized air from the pneumatic actuator, and which pressurized air is directed into the air chamber of the housing to force the conductive plunger against the electrical connection for completing a circuit for generating a signal in the patient call system. In an embodiment of the invention, the interchangeable air connector assembly has a snap fit connection with the housing and is constructed to selectively position the air conduit at a right angle relative to or in line with the electrical connection. That is, the connector assembly is interchangeable and comprises a first snap fit air connector assembly constructed to position the air conduit at a first angle, for example, at a right angle, with the electrical connection and the conductive element, and a second snap fit air connector assembly constructed to position the air conduit at a second angle, such as, at an 180 degree angle, i.e. in alignment with the electrical connection.

In an embodiment of the invention, the first snap fit air connector assembly and the second snap fit air connector assembly comprise a recessed portion and the air conduit comprises a plurality of fins for securing a pneumatic hose to the air conduit and which hose is press fitted onto the fins of the air conduit and wedged into the recessed portion. In a further embodiment, the air conduit of the air connector assemblies comprise a plurality of barbs for securing the pneumatic hose to the air conduit which hose is press fitted onto the barbs. The contact spring is associated with the conductive plunger and repositions the conductive plunger away from the electrical connection for opening the circuit thereby interrupting the signal in the pneumatic patient call system.

A further aspect of the present invention provides a pneumatic actuator system for a patient call system, comprising: a pneumatic actuator; a pneumatically actuated switching device comprising an electrical connection and an air conduit; and a pneumatic hose connectable to the pneumatic actuator and to the air conduit of the pneumatically actuated switching device for delivering pressurized air to the pneumatically actuated switching device upon operation of the pneumatic actuator for generating an electrical signal when the pneumatic actuator is operated; and an interchangeable air connector assembly for the switching device comprising the air conduit and constructed to selectively position the air conduit at an angle relative to the electrical connection. In an embodiment of the invention, the air connector assembly is interchangeable and comprises a first snap fit air connector assembly constructed to present the air conduit at a first angle, for example, at a right angle relative to the electrical connection and a second snap fit air connector assembly constructed to present the air conduit at a second angle different from the first angle, for example, at a 180 degree angle, i.e. in line with the electrical connection. In an embodiment of the invention, the first snap fit air connector and the second snap fit air connector assemblies comprise a recessed portion and an air conduit comprises a plurality of fins for press fitting and securing a pneumatic hose to the air conduit located in the recessed portion of the air connector assembly. In a further embodiment, the air conduit of the air connector assemblies comprises a plurality of barbs for securing the pneumatic hose to the air conduit. The contact spring is associated with the conductive plunger and repositions the conductive plunger away from the electrical connection for opening the circuit thereby interrupting the signal in the pneumatic patient call system.

A still further aspect of the present invention provides a method for constructing a pneumatic actuator system for a patient call system, the switching device comprising a conductive plunger and a spring, which conductive plunger is forced by pressurized air delivered to the switching device by an air conduit against an electrical connection for completing a circuit, comprising: providing an interchangeable air connector assembly comprising a first snap fit air connector assembly constructed to position an air conduit at a first angle with the electrical connection of the pneumatically actuated switching device, for example, at a right angle relative to the electrical connection and a second snap fit air connector assembly constructed to position an air conduit at a second angle, for example, at an 180 degree angle, i.e. in alignment with the electrical connection of the pneumatically actuated switching device; and selectively inserting the first snap fit air connector assembly and the second snap fit connector assembly into the housing of the pneumatically actuated switching device depending on a desired configuration of the pneumatic actuator system.

It is therefore an object of the present invention to provide a pneumatically actuated switching device having an interchangeable snap fit air connector assembly constructed to selectively position the pneumatically actuated switching device at a predetermined angle for receiving pressurized air for actuating a signal in a patient call system.

It is a further object of the present invention to provide a pneumatically actuated switching device comprising an air connector assembly that is interchangeable, and wherein a first snap fit air connector assembly has an air conduit in communication with the housing of the actuated switching device and at a right angle relative to an electrical connection and a pneumatic actuator producing pressurized air for actuating a signal in a patient call system, and wherein a second snap fit air connector assembly has an air conduit in communication with the housing of the actuated switching device and in line with the electrical connection.

It is still a further object of the present invention to provide an interchangeable air connector assembly that comprises means for securing a pneumatic hose to an air conduit thereof.

These and other objects of the invention will be better appreciated and understood when read in light of the accompanying drawings.

DETAILED DESCRIPTION OF THE INVENTION

The pneumatically actuated switching device of the invention can be used in a variety of systems and environments in which it is desirable to switch an electrical circuit on or off by remote means. The device is particularly well suited for use with conventional nurse call signal systems and since in this context the features of the invention are highlighted, the invention is described herein in combination with such a system. However, it should be understood that the invention is not limited to such use.

Figure 1:
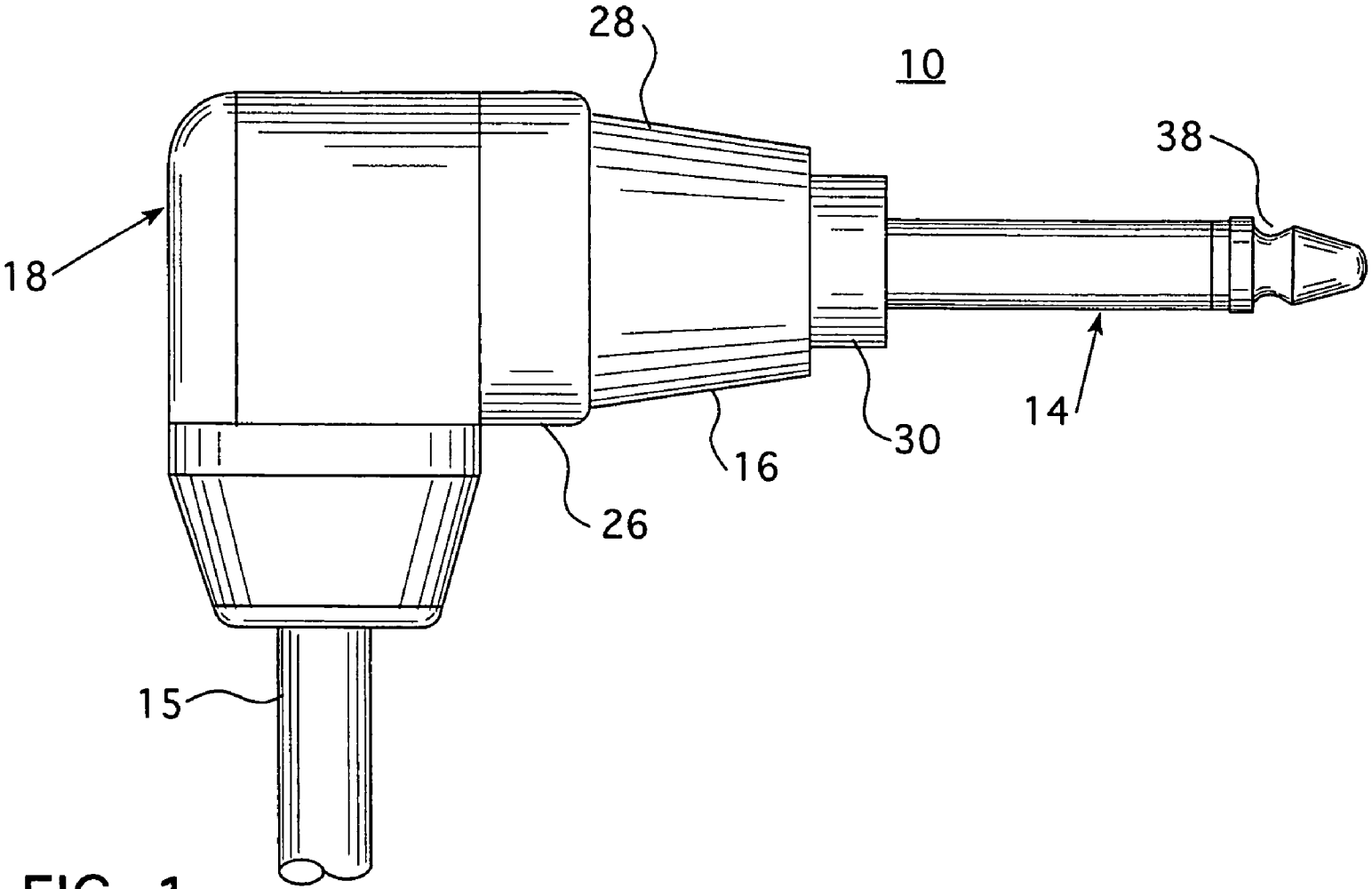
FIG. 1 is a side elevation view of a pneumatically actuated switching device according to the present invention utilizing a right angle air connector assembly/housing option.
Figure 2:
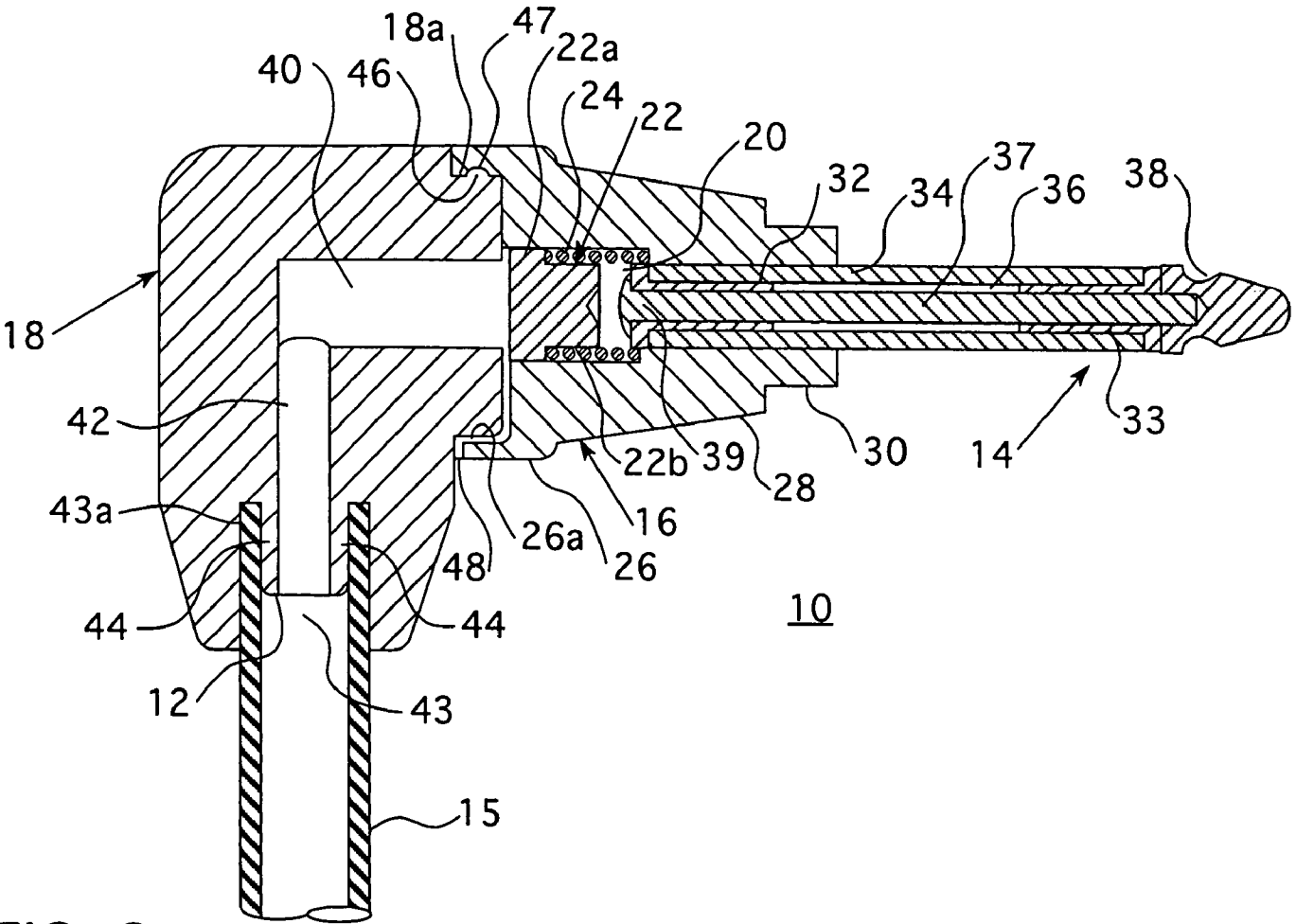
FIG. 2 is a cross sectional view of the pneumatically actuated switching device of FIG. 1.
Figure 3:
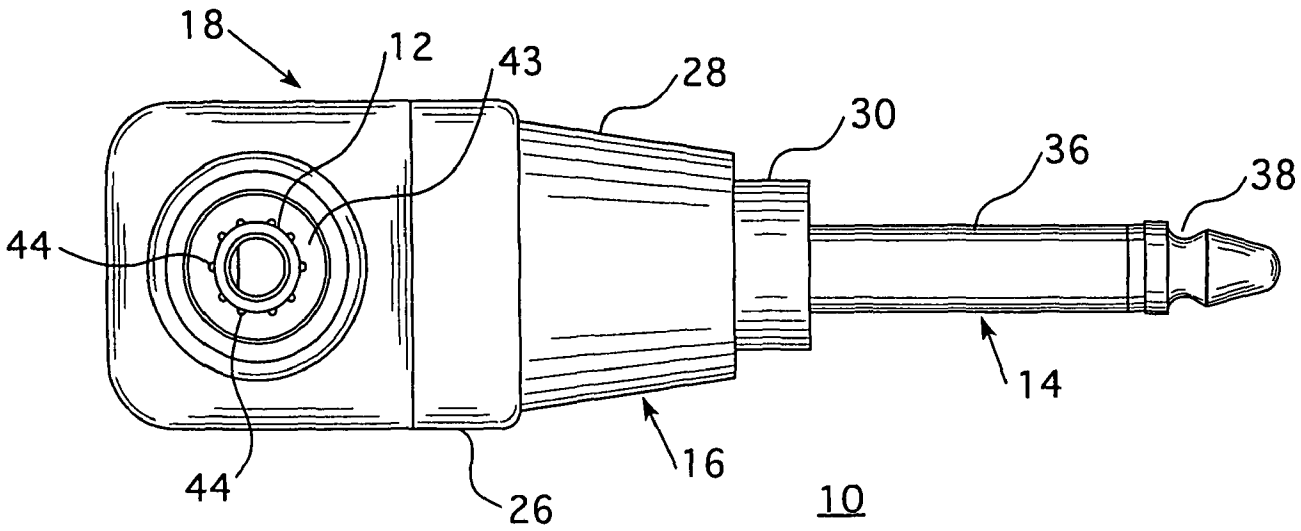
FIG. 3 is an underside view of the device of FIG. 1 showing fins associated with an air conduit for connection of a pneumatic hose.
Figure 4:
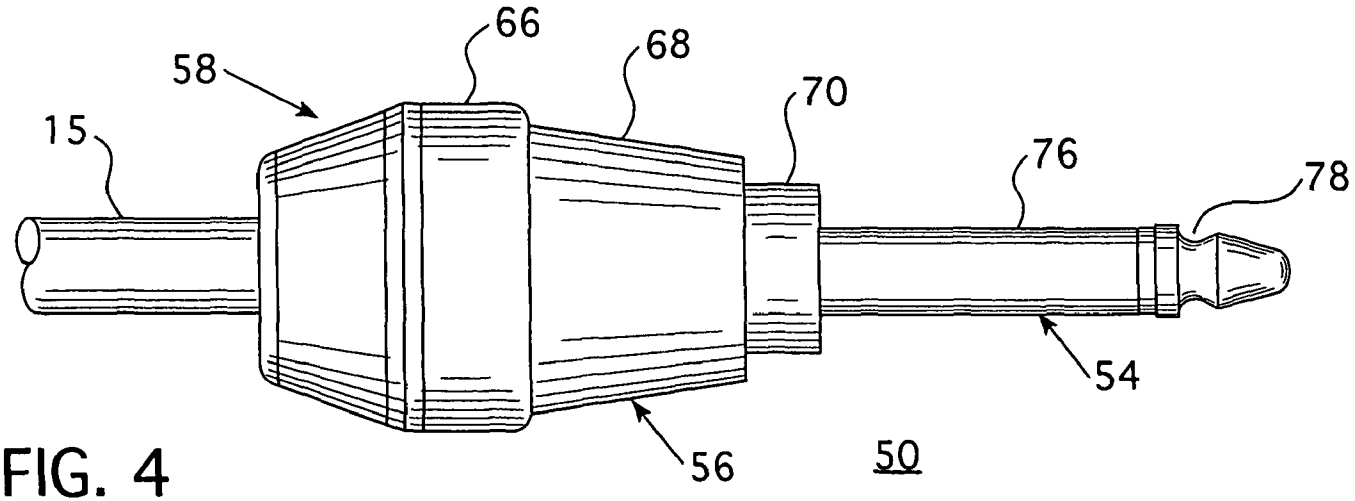
FIG. 4 is a side elevation view of a pneumatically actuated switching device according to the present invention utilizing an in-line air connector assembly/housing option.
Figure 5:
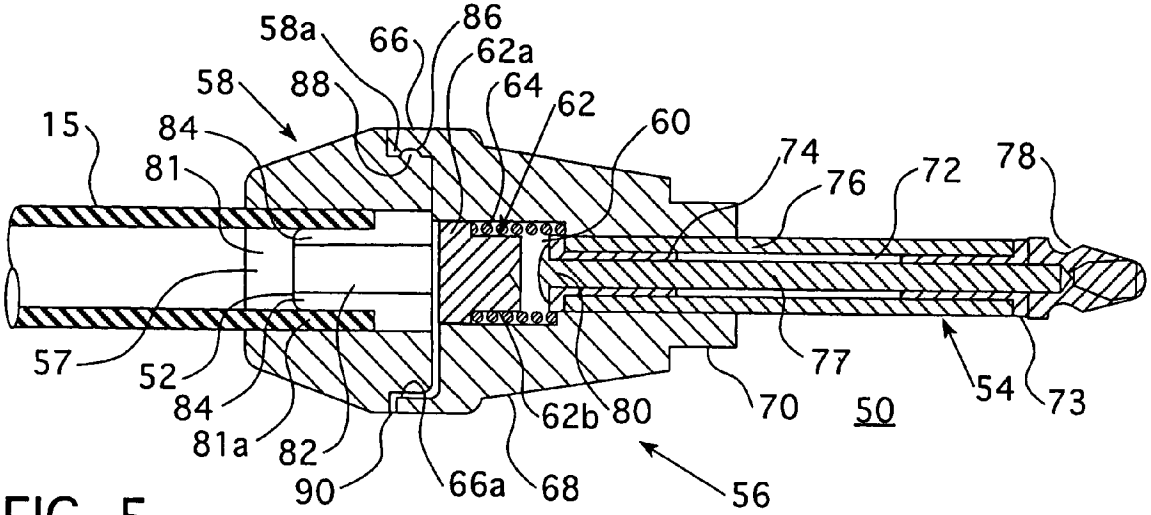
FIG. 5 is a cross sectional view of the pneumatically actuated switching device of FIG. 4.
Figure 6:
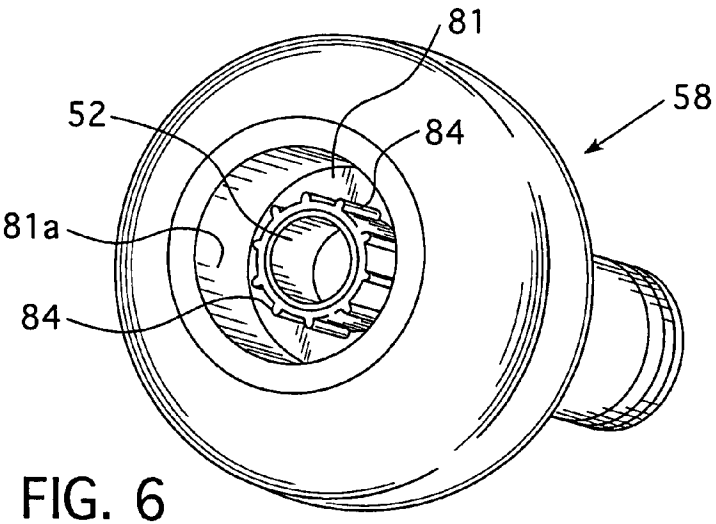
FIG. 6 is an enlarged perspective view of the pneumatically actuated switching device of FIG. 4 showing fins associated with an air conduit for connection of a pneumatic hose.

FIGS. 1 through 3 shows a right angle configuration for a pneumatically actuated switching device 10, and FIGS. 4 through 6 shows an in-line configuration for a pneumatically actuated switching device 50, the assembly options being described below. FIGS. 1 through 3 show the pneumatically actuated switching device 10 for positioning an air conduit 12 (FIGS. 2 and 3) at a right angle relative to an electrical connection 14; whereas FIGS. 4 through 6 show the pneumatically actuated switching device 50 for positioning an air conduit 52 (FIG. 5) in alignment, i.e. at an 180 degree angle, relative to an electrical connection 54.

The pneumatically actuated switching devices 10 and 50 are connected to a pneumatic actuator (not shown) via air conduit 12 and 52, respectively, of a patient call system. An example of a pneumatic actuator for a patient call system in which the devices 10 and 50 of the present invention may be connected is disclosed in the aforesaid U.S. Pat. No. 5,736,702. That is, in a similar fashion, pneumatically actuated switching device 10 is connected via air conduit 12 and a pneumatic hose 15 (FIG. 2) and device 50 is connected via air conduit 52 and a pneumatic hose 15 (FIG. 5) to a pneumatic actuator (not shown) which may be an actuator bulb similar to that disclosed in U.S. Pat. No. 5,736,702 which is constructed to produce a pulse of pressurized air which is delivered to the pneumatic actuated switching devices 10 and 50, respectively, to form a momentary electrical signal circuit with a receptacle of a patient call system.

With particular reference to FIGS. 1 through 3, the pneumatically actuated switching device 10, in addition to air conduit 12 and electrical connection 14, further comprises a housing 16 and a first snap fit air connector assembly 18 for supporting and positioning the air conduit 12 at a right angle relative to the electrical connection 14. Housing 16 and air connector assembly 18 are preferably made of a non-conductive material, for example, plastic and may be manufactured through an injection molding process.

Referring particularly to FIG. 2, housing 16 comprises an air chamber 20 which houses a conductive plunger 22 which is slidably contained in air chamber 20. A relatively close tolerance fit will be required between the conductive plunger 22 and air chamber 20 to ensure that the conductive plunger 22 will slide in response to a pressure pulse delivered to the air connector assembly 18. If the gap existing between the conductive plunger 22 and the air chamber 20 is too great, the pulse of air might pass by the plunger instead of driving the conductive plunger 22 into the air chamber 20.

Air chamber 20 extends through housing 16 which comprises an inner enlarged diameter portion 26, a middle tapered portion 28, and a reduced diameter end portion 30. Conductive plunger 22 has an enlarged diameter portion 22*a* and a reduced diameter portion 22*b* which create a ledge for contact with a spring 24. Contact spring 24 acts to maintain separation, in the absence of a pressure pulse, between the conductive plunger 22 and a portion of the electrical connection components, as will be described in greater detail below.

Still referring to FIG. 2, electrical connection 14 is a jack that extends from the reduced diameter end portion 20 of housing 16 for electrical connection with the receptacle of a patient call system. Electrical connection 14 includes a conductive outer body 34 having an inner cavity 36 extending along the entire elongated length of outer body 34. As shown in FIG. 2, the conductive outer body 34 is positioned within an opening in the housing 16 such that a first portion or an end of the conductive outer body 34 confronts an end of air chamber 20. The conductive outer body 34 and the opening in the housing 16 are tolerance so that a slight interference fit will exist to maintain the position of the conductive outer body 34 within housing 16. Even though not shown, preferably, the conductive outer body 34 further includes a knurled portion in the region of the connection to the housing 16 to enhance the gripping strength of the connection there between.

Still referring to FIG. 2, the conductive outer body 34 includes inner cavity 36 which houses a conductive core 37 that extends beyond both ends of the outer body 34 thereby forming at one end an extension 39 which extends into the air chamber 20 for contact with plunger 22. This conductive core 37 extends from the opposite end of the outer body 34 to connect to an electrical conductive element or a conductive jack tip 38 at a second portion of the outer body 34, which jack tip 38 is inserted into a receptacle of a patient call system. Plunger 22 and extension 39, as shown, have compatible interfitting surfaces providing for conductive contacting surfaces. Insulators 32 and 33 are located at opposed ends of conductive outer body 34 and core 37. Insulators 32 and 33 provide for electrical separation between jack tip 38 and the outer body 34 and between core 37 and the outer body 34. Both the tapered portion 28 and the reduced diameter portion 30 of housing 16 substantially support the conductive outer body 34 of electrical connection 14 in housing 16 so that electrical connection 14 remains in a stable, fixed position within housing 16.

As stated hereinabove, contact spring 24 provides for the separation of the plunger 22 and the extension 39 of conductive electrical element 38 in the absence of a pressure pulse. Spring 24 is preferably made from a conductive material so that it also provides for an electrical pathway between plunger 22 and the end of the outer body 34 confronting the air chamber 20. Specifically, contact spring 24 has an end section with a reduced diameter spiral for seating of that portion of the spring between the outer body 34 and insulator 32 to ensure good conductive contact between spring 24 and conductive outer body 34.

The electrical connection of the pneumatically actuated switching device 10 is similar to the pneumatic switch of the aforesaid U.S. Pat. No. 5,736,702 which is incorporated hereby by reference in its entirety. Thus, a temporary electrical connection will result in the following manner. A first electrical pathway will exist between the receptacle and the plunger 22 through the outer body 34 and the contact spring 24. A second pathway will extend from the receptacle to the extension 39 of electrical connection 14 through the jack tip 38. The first and second pathways are kept electrically separated from one another by insulator 32 between the core 37 and the outer body 34 and insulator 33 between jack tip 38 and the outer body 34. Upon the entrance of a pressure pulse into air chamber 20, plunger 22 will slide in air chamber 20 resulting in contact between plunger 22 and the extension 39 of electrical connection 14. This contact will unite the two electrical pathways resulting in an electrical signal, which may be monitored at a central location, such as a nurse's station, indicating that the switch has been activated.

Still referring particularly to FIG. 2, the first snap fit air connector assembly 18 comprises air chambers 40 and 42 which are in communication with each other and which chambers 40 and 42 are arranged at right angles relative to each other. Air chamber 40 is in fluid communication with air chamber 20 of housing 16 and air chamber 42 extends into and from air conduit 12. As specifically shown in FIGS. 2 and 3, the first snap fit air connector assembly further comprises a circular recessed portion 43 for housing air conduit 12. Circular recessed portion 43 has a sidewall 43*a* that cooperates with the external surface of air conduit 12 to tightly receive and secure a pneumatic hose 15 (FIG. 2) in a wedge-like fashion in recessed portion 43. Air conduit 12 is a fixed component of the first snap fit air connector assembly 18 and comprises a plurality of fins 44 (FIG. 3). Fins 44 help in gripping air hose 15 to air conduit 12 in that pneumatic hose 15 is inserted into the recessed portion 43 and pressed tightly onto air conduit 12 and between the external surface of air conduit 12 and side wall 43*a* of circular recessed portion 43 as shown in FIG. 2 thereby wedging air hose 15 in recessed portion 43. This securing of pneumatic hose 15 onto vertical fins 44 of air conduit 12 and between the external surface of air conduit 12 and sidewall 43*a* of recessed portion 43*a* generally is such that the pneumatic hose 15 will not easily pull out of air connector assembly 18 under normal circumstances and general day to day use of switching device 10. This construction of pneumatic switching device 10 provides a pathway for the pulse of pressurized air which extends from the pneumatic bulb (not shown), through pneumatic hose 15 and into air conduit 12, through air chambers 42 and 40 of assembly 18, and into air chamber 20 of housing 16.

Still referring to FIG. 2, air connector assembly 18 has a reduced diameter portion 18*a* for confronting housing 16 and which portion 18*a* creates a ledge for receiving a corresponding recessed end 26*a* of inner diameter portion 26 of housing 16. The reduced diameter portion 18*a* of assembly 18 has an outward protruding locking key 46 and the recessed end 26*a* of inner diameter portion 26 of housing 16 has an inward keyway 47 which receives locking key 46 when assembly 18 is mounted in housing 16, thereby providing for the snap fit connection between housing 16 and assembly 18. Locking key 46 generally will extend substantially around the external periphery of the reduced diameter portion 18*a* and keyway 47 will generally extend substantially around the inner circumference of the recessed end 26*a* of inner diameter portion 26 of housing 16. This construction of key 46 and keyway 47, in addition for providing a snap fit connection between housing 16 and assembly 18, also provides for a tight tolerance fit between housing 16 and assembly 18, which under normal circumstances and general day to day use of switching device 10, does not allow housing 16 and assembly 18 to become disassembled.

As shown in FIG. 2, a bleed pathway 48 exists between the reduced diameter portion 18*a* and the recessed end 26*a* of inner diameter portion 26 of housing 16, thereby interrupting the locking key 46 and keyway 47. The diameter of this bleed pathway 48 may measure about 0.03125 inch to about 0.0625 inch and bleed pathway 48 allows for the escape of air present in the air chamber 20 and adjacent to spring 24 which would otherwise be pressurized in the absence of the bleed pathway 48. Releasing of the air pressure in device 10 allows contact spring 24 to slide conductive plunger 22 away from conductive element 14 for opening of the circuit and resetting of device 10.

For operation of pneumatically actuated switching device 10, pneumatic hose 15 is connected to a pneumatic actuator and electrical connection 14 is plugged into a receptacle of a pneumatic patient call system. The pneumatic actuator or bulb is pressed and pressurized air is forced through pneumatic hose 15 and into air conduit 12, through air chambers 42 and 40 of connector assembly 18 and into air chamber 20 of housing 16. The pressurized air is forced against conductive plunger 22 to slide conductive plunger 22 thereby causing conductive plunger 22 to contact extension 39 to complete the circuit for generating a signal to the patient call system. Since the pressurized air is delivered momentarily, this signal is only activated momentarily. The pressurized air in assembly 18 and/or in housing 16 is released through the bleed pathway 48. Subsequently, contact spring 24 pushes conductive plunger 22 away from extension 39 for opening of the circuit.

Figure 7:
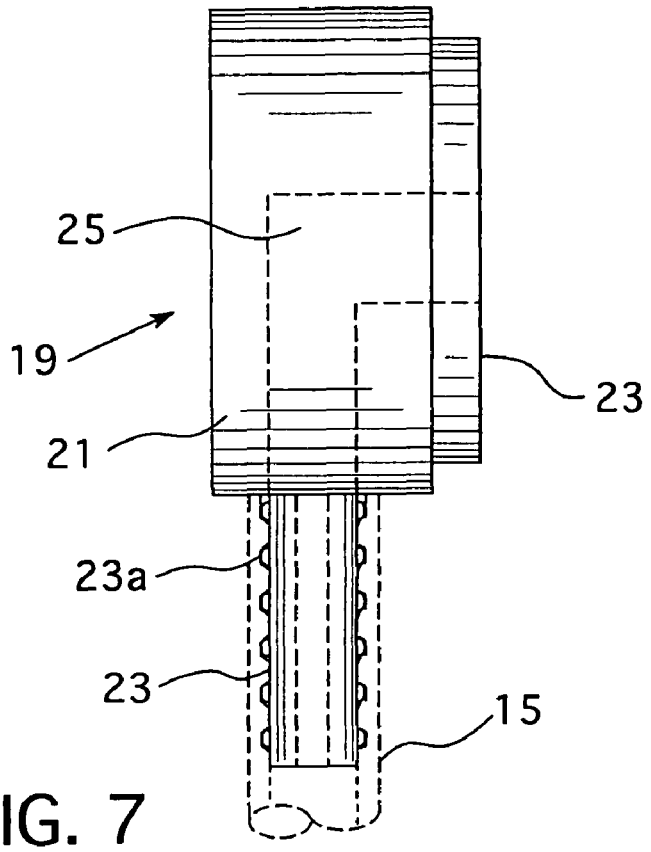
FIG. 7 is a side elevation view of a right angle air connector assembly/housing of a further embodiment of the invention.

FIG. 7 shows an air connector assembly 19 which is an alternative arrangement for the air connector assembly 18 of FIGS. 1-3. Connector assembly 19 comprises an enlarged diameter portion 21; a reduced diameter portion 23; an air passage 25 and an air conduit 23 that extends from the enlarged diameter portion 21. Air conduit 23 is constructed to receive a pneumatic hose 15 (shown in phantom) which delivers pressurized air in a manner described herein above and comprises a plurality of barbs 23*a* for tightly securing the pneumatic hose to air conduit 23. Even though not shown in FIG. 7, the reduced diameter portion 23 may include a key similar to key 46 of FIG. 2 for insertion into a keyway in a manner similar to that described and shown herein above for the embodiment of FIGS. 1-3. Or, as shown in FIG. 7, the periphery of the reduced diameter portion 23 may have a flat surface with a close tolerance fit with a housing having a corresponding surface. For assemblage, portion 23 of connector assembly 19 is pushed into the housing and retained therein via a snap-fit action of these components thereby bringing air passage 25 in fluid communication with the air chamber of the housing. A close tolerance fit between the air connector assembly 19 and its respective housing will retain these two components in an assembled state. In this embodiment, barbs 23*a* provide for a secure and close tolerance or wedge-like fit for pneumatic hose 15 onto air conduit 23 such that under normal circumstances and general day to day use, the pneumatic hose 15 will not be dislodged from the air conduit 23 of air connector assembly 19.

The connector assembly 18 of the device 10 of FIGS. 1 through 3 is interchangeable and may be removed and replaced with an air connector assembly 58 of the pneumatically actuated switching device 50 of FIGS. 4 through 6. All of the components of FIGS. 4 through 6 are similar to that of device 10 of FIGS. 1 through 3, except for air connector assembly 58.

With particular reference to FIGS. 4 through 6, the pneumatically actuated switching device 50, in addition to an air conduit 52 and electrical connection 54, further comprises a housing 56 and the air connector assembly 58 for supporting and positioning air conduit 52 in alignment with electrical connection 54, that is, at a 180 degree angle relative to electrical connection 54.

Referring particularly to FIG. 5, housing 56 comprises an air chamber 60 which houses a conductive plunger 62 which is slidably contained in air chamber 60 and a contact spring 64. Conductive plunger 62 has an enlarged diameter portion 62*a* and a reduced diameter portion 62*b* which create a ledge for contact with spring 64. Contact spring 64 acts to maintain separation, in the absence of a pressure pulse, between the plunger 62 and the electrical connection 54 in the manner described herein above for the device 10 of FIGS. 1 through 3.

Housing 56 comprises an enlarged diameter portion 66, a tapered portion 68, and a reduced diameter portion 70 in which air chamber 60 extends there through. As also shown particularly in FIG. 5, electrical connection 54 has a first portion extending from the housing 56 and a second portion extending into air chamber 60 of housing 56. Electrical connection 54 includes a conductive outer body 76 having an inner cavity 72 extending along the entire elongated length of the outer body 76. As shown in FIG. 5, the conductive outer body 76 is positioned within an opening in the housing 56 such that an end of the conductive outer body 76 confronts an end of air chamber 60. The conductive outer body 76 and the opening in housing 56 are tolerance so that an interference fit will exist to maintain the position of the conductive outer body 76 within housing 56. Even though not shown, preferably, the conductive outer body 76 further includes a knurled portion in the region of the connection to the housing 56 to enhance the gripping strength of the connection there between.

Still referring to FIG. 5, the conductive outer body 76 includes inner cavity 72 which houses a conductive core 77 that extends beyond both ends of the outer body 76 thereby forming at one end an extension 80 which extends into air chamber 60 for contact with plunder 62. This conductive core 77 extends from the opposite end of the outer body 76 to connect to an electrical conductive element or a conductive jack tip 78, which is inserted into the receptacle of a patient call system. Plunger 62 and extension 80, as shown, have compatible interfitting surfaces providing for conductive contacting surfaces. Insulators 73 and 74 are located at opposed ends of conductive outer body 76 and core 77. Insulators 73 and 74 provide for electrical separation between jack tip 78 and the outer body 76 and between core 77 and the outer body 76. Both the tapered portion 68 and the reduced diameter portion 70 of housing 56 substantially support the conductive outer body 76 in housing 56 so that electrical connection 54 remains in a stable, fixed position within housing 56.

Contact spring 64 provides for the separation of the plunger 62 and extension 80 of conductive electrical element 54 in the absence of a pressure pulse. Spring 64 is preferably made from a conductive material so that it also provides for an electrical pathway between plunger 62 and the end of the outer body 76 confronting the air chamber 60. Specifically, contact spring 64 has an end section with a reduced diameter spiral for seating of that portion of the spring between the outer body 76 and insulator 74 to ensure good conductive contact between spring 64 and outer body 76.

As described herein above, the electrical connection 54 of the pneumatically actuated switching device 50 is similar to the pneumatic switch of the aforesaid U.S. Pat. No. 5,736,702. A first electrical pathway will exist between the receptacle and the plunger 62 through the outer body 76 and the contact spring 64. A second pathway will extend from the receptacle to the extension 80 of electrical connection 54 through the jack tip 78. The first and second pathways are kept electrically separated from one another by insulator 74 between core 77 and the outer body 76 and insulator 73 between jack tip 78 and outer body 76. Upon the entrance of a pressure pulse into air chamber 60, plunger 62 will slide in air chamber 60 resulting in contact between plunger 62 and extension 80 of electrical connection 54. This contact will unite the two electrical pathways resulting in an electrical signal, which may be monitored at a central location, such as a nurse's station, indicating that the switch has been activated.

Still referring to FIG. 5, the second snap fit air connector assembly 58 comprises an air chamber 82 which is in fluid communication with air chamber 60 of housing 56 and extends in air conduit 52. Air conduit 52 is located in a circular recessed portion 81 of assembly 58 and chambers 60 and 82 are arranged in line relative to each other and relative to electrical connection 54. Air conduit 52 is a permanent component of second snap fit air connector assembly 58 and has an external surface that comprises a plurality of fins 84 as better shown in FIG. 6. Fins 84 secure air hose 15 to air conduit 52 in that pneumatic air hose 15 is inserted into recessed portion 81 of air connector assembly 58 and onto air conduit 52 in a manner that air hose 15 is wedged between sidewall 81*a* of recessed portion 81 and onto the fins 84 of the external surface of air conduit 52 as shown in FIG. 5. The securing or gripping of hose 15 onto fins 84 and between the external surface of air conduit 52 and sidewall 81*a* of circular recessed portion 81 generally is such that hose 15 will not easily pull out of connector assembly 58 under normal circumstances and general day to day use of switch device 50. The construction of switching device 50 provides a pathway for the pulse of pressurized air which extends from the pneumatic bulb (not shown), through pneumatic hose 15 and into air conduit 52, through air chamber 82 of assembly 58 and into air chamber 60 of housing 56.

Still referring to FIG. 5, air connector assembly 58 has a reduced diameter portion 58*a* for confronting housing 56 and which creates a ledge for receiving a recessed end 66*a* of inner diameter portion 66 of housing 56. The reduced diameter portion 58*a* has an outward protruding locking key 88 and the recessed end 66*a* of inner diameter portion 66 of housing 56 has an inward keyway 86 for receiving locking key 88 when assembly 58 is mounted in housing 56, thereby providing for the snap fit connection between housing 56 and assembly 58. Locking key 88 generally will extend substantially around the external periphery of the reduced diameter portion 58*a* and keyway 86 generally will extend substantially around the inner circumference of the recessed end 66*a* of inner diameter portion 66 of housing 56. This construction of locking key 88 and keyway 86, in addition for providing a snap fit connection between housing 56 and assembly 58, which under normal circumstances and general day to day use of switching device 50, does not allow housing 56 and assembly 58 to become easily disassembled.

As shown in FIG. 5, a bleed pathway 90 exists between the reduced diameter portion 58*a* and the recessed end 66*a* of inner diameter portion 66 of housing 56 thereby interrupting key 88 and keyway 86. The diameter of this bleed pathway 90 may measure about 0.03125 inch to about 0.0625 and bleed pathway 90 allows for the escape of air present in air chamber 60 and adjacent to spring 64 which would otherwise be pressurized in the absence of the bleed pathway 90. Releasing of the air pressure in device 50 allows contact spring 64 to slide conductive plunger 62 away from conductive element 54 for opening the circuit and resetting device 50.

The operation of pneumatically actuated switching device 50 is similar to that of switching device 10 as explained herein above.

Figure 8:
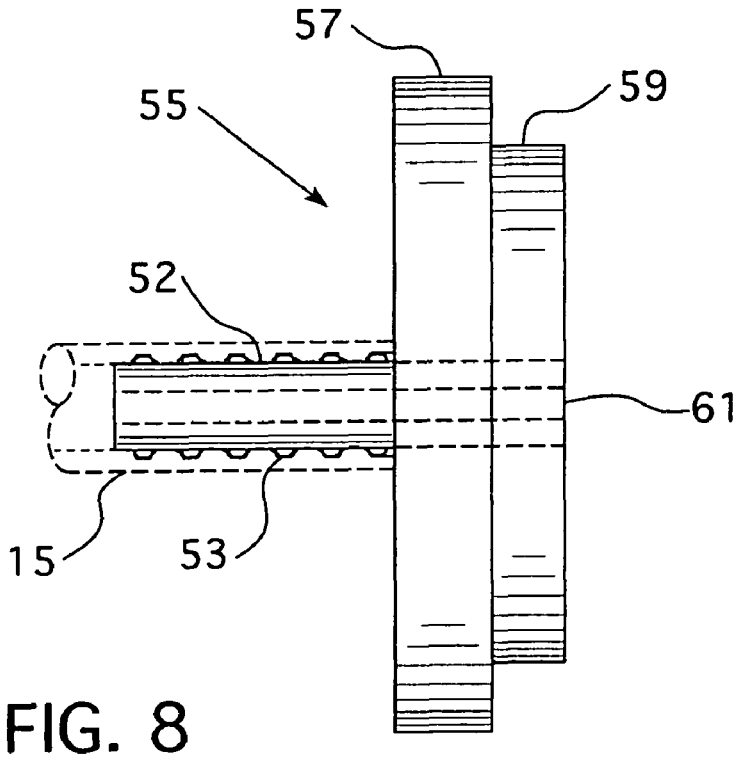
FIG. 8 is a side elevation view of an in-line air connector assembly/housing of a further embodiment of the invention.

FIG. 8 shows an air connector assembly 55 which is an alternative arrangement for the air connector assembly 58 of FIGS. 4-6. Connector assembly 55 comprises an enlarged diameter portion 57; a reduced diameter portion 59; and air passage 61 and an air conduit 52 that extends from the enlarged diameter portion 57. Air conduit 52 is constructed to receive a pneumatic hose 15 (shown in phantom) which delivers pressurized air in a manner described herein above and comprises a plurality of barbs 53 for tightly securing or gripping the pneumatic hose 15 to air conduit 52. Even though not shown in FIG. 8, the reduced diameter portion 59 may include a key similar to key 88 of FIG. 5 for insertion into a keyway in a manner similar to that shown in FIG. 5. Or, as shown in FIG. 8, the periphery of the reduced diameter portion 59 may have a flat surface with a close tolerance fit with a housing having a corresponding surface. For assemblage, the enlarged diameter portion 59 of connector assembly 55 is pushed into the housing and retained therein via a snap-fit action between these components thereby bringing air passage 61 in fluid communication with the air chamber of the housing and the close tolerance fit between the air connector assembly 55 and the housing will retain these two components in an assembled state. In this embodiment, barbs 53 provide a wedging action for securing pneumatic hose 15 to air conduit 52 such that under normal circumstances and general day to day use, the pneumatic hose 15 will not be dislodged from air conduit 52 of the air connector assembly 55.

A method for constructing a pneumatically actuated switching device 10, 50, comprising a housing and an electrical connection, for a pneumatic actuator system for a patient call system such as that shown in FIGS. 1 through 8, includes the steps of: providing an interchangeable connector assembly 18, 58 comprised of a first snap fit air connector assembly 18 constructed to present the air conduit 24 of the pneumatically actuated switching device 10 at a right angle with electrical connection 14 and a second snap fit air connector assembly 58 constructed to present the air conduit 52 of the pneumatically actuated switching device 50 in alignment with the electrical connection 54 of the pneumatically actuated switching device 50; and selectively inserting the first snap fit air connector assembly 18 and the second snap fit air connector assembly 58 to the pneumatically actuated switching device 10,50 depending on a desired configuration for the pneumatic actuator system.

Air connector assemblies 18 and 58 and housings 16 and 56 are made of a suitable nonconductive material, such as plastic and these components may be manufactured by an injection molding process; whereas, conductive plungers 22 and 62 are made of an electrical conductive material, such as metal. Even though a conductive plunger and contact spring are shown to be the housings 16 and 56 of FIGS. 1-6, it is to be appreciated that these elements may be located in air connector assemblies 18 and 58.

While the present invention has been described in connection with the embodiments of the various figures, it is to be understood that other similar embodiments may be used or modifications and additions may be made to the described embodiments for performing the same function of the present invention without deviating there from. Therefore, the present invention should not be limited to any single embodiment, but rather construed in breadth and scope in accordance with the recitation of the appended claims.

The invention claimed is:

1. A pneumatically actuated switching device comprising:

a housing having an air chamber;

a conductive plunger and a contact spring in association with the air chamber of the housing;

an electrical connection having a first portion extending from the housing and comprising an electrical conductive element receivable in a receptacle of a wall switching unit, and a second portion extending into the air chamber of the housing; and an interchangeable air connector assembly constructed to be connected to the housing and comprising an air conduit extending from the air connector assembly and connectable to a pneumatic actuator for generating and discharging a quantity of pressurized air;

the air conduit of the interchangeable air connector assembly being in communication with the air chamber of the housing for receiving the pressurized air from the pneumatic actuator, which pressurized air is directed into the air chamber of the housing to force the conductive plunger against the electrical connection for completing a circuit for generating a signal in the patient call system;

the interchangeable air connector assembly constructed to selectively position the air conduit of the interchangeable air connector assembly at a predetermined angle relative to the electrical connection.

2. The pneumatically actuated switching device of claim 1 wherein the interchangeable air connector assembly comprises a first snap fit air connector assembly constructed and adapted to position the air conduit at a first angle with the electrical connection and a second snap fit air connector assembly constructed and adapted to position the air conduit at a second angle relative to the electrical connection which is different from the first angle of the first snap fit air connector assembly.

3. The pneumatically actuated switching device of claim 1 wherein the interchangeable air connector assembly comprises a first snap fit air connector assembly constructed to position the air conduit at a right angle relative to the electrical connection and a second snap fit air connector assembly constructed to position the air conduit in alignment with the electrical connection.

4. The pneumatic actuated switching device of claim 1 wherein the interchangeable air connector assembly comprises a recessed portion and the air conduit of the interchangeable air connector assembly is located in the recessed portion and wherein the air conduit comprises a plurality of fins for securing a pneumatic hose in the recessed portion of the interchangeable air connector assembly.

5. The pneumatic actuated switching device of claim 1 wherein the air conduit of the interchangeable air connector assembly comprises a plurality of barbs for securing a pneumatic hose to the air conduit of the interchangeable air connector assembly.

6. The pneumatic actuated switching device of claim 1 wherein the housing and the interchangeable air connector assembly comprise a keyway and a key for a snap fit connection between the housing and the air connector assembly.

7. A pneumatic actuator system for a patient call system, comprising:

a pneumatic actuator for generating and discharging a quantity of pressurized air;

a pneumatically actuated switching device comprising a housing having an air chamber, a conductive plunger and a contact spring in association with the air chamber for opening and closing a circuit, an electrical connection extending into the air chamber and including an electrical conductive element; and an air conduit; and a pneumatic hose connectable to the pneumatic actuator and to the air conduit of the pneumatically actuated switching device for delivering pressurized air to the pneumatically actuated switching device upon operation of the pneumatic actuator for generating an electrical signal when the pneumatic actuator is operated;

the pneumatically actuated switching device further comprising an interchangeable air connector assembly constructed to selectively position the air conduit at a predetermined angle relative to the electrical connection for completing a circuit for generating the signal in the patient call system.

8. The pneumatic actuator system of claim 7, wherein the interchangeable air connector assembly comprises a first snap fit air connector assembly constructed to position the air conduit at a first angle relative to the electrical connection and a second snap fit air connector assembly constructed to position the air conduit at a second angle relative to the electrical connection.

9. The pneumatic actuator system of claim 8, wherein the interchangeable air connector assembly comprises a first snap fit air connector assembly constructed to position the air conduit at a right angle relative to the electrical connection and a second snap fit air connector assembly constructed to position the air conduit in alignment with the electrical connection.

10. The pneumatic actuated switching device of claim 8 wherein the interchangeable air connector assembly comprises a recessed portion and wherein the air conduit is located in the recessed portion and comprises a plurality of fins for securing a pneumatic hose in the recessed portion of the interchangeable air connector assembly.

11. The pneumatic actuated switching device of claim 10 wherein the air conduit of the interchangeable air connector assembly comprises a plurality of barbs for securing a pneumatic hose to the interchangeable air connector assembly.

12. The pneumatic actuated switching device of claim 8 wherein the housing and the interchangeable air connector assembly comprise a key and keyway for a snap fit connection between the housing and the air connector assembly.

13. A method for constructing a pneumatically actuated switching device for a pneumatic actuator system, the switching device comprising a conductive plunger and a spring, which conductive plunger is forced by pressurized air delivered to the switching device by an air conduit against an electrical connection for completing a circuit, comprising;

providing an interchangeable air connector assembly comprised of a first snap fit air connector assembly constructed and adapted to position an air conduit of the interchangeable air connector assembly at a right angle with the electrical connection of the pneumatically actuated switching device; and a second snap fit air connector assembly constructed and adapted to position an air conduit of the interchangeable air connector assembly in alignment with the electrical connection for delivering the pressurized air to the switching device; and selectively inserting the first snap fit air connector assembly and the second snap fit air connector assembly into the housing of the pneumatically actuated switching device depending on a desired configuration for the pneumatic actuator system.

* * * * *